US005779182A

United States Patent [19]

Raudaskoski

[11] Patent Number: 5,779,182

[45] Date of Patent: Jul. 14, 1998

[54] METHOD AND DEVICE FOR WINDING A MATERIAL WEB

[75] Inventor: Vesa Raudaskoski, Järvenpää, Finland

[73] Assignee: Valmet Corporation, Helsinki, Finland

[21] Appl. No.: 747,462

[22] Filed: Nov. 12, 1996

[30] Foreign Application Priority Data

Nov. 24, 1995 [FI] Finland ..... 955666

[51] Int. Cl.[6] ..... B65H 18/14

[52] U.S. Cl. ..... 242/541.4; 242/547

[58] Field of Search ..... 242/541.4, 541.7, 242/542, 542.2, 908, 541.5, 541.6, 542.3, 547

[56] References Cited

U.S. PATENT DOCUMENTS

| | | | |
|---|---|---|---|
| 3,346,209 | 10/1967 | Cronin | 242/908 X |
| 3,497,151 | 2/1970 | Voss et al. | 242/908 X |
| 4,256,269 | 3/1981 | Feighery et al. | 242/542.2 X |
| 5,492,287 | 2/1996 | Raudaskoski | 242/541.4 |
| 5,499,779 | 3/1996 | Raudaskoski | 242/541.4 |
| 5,505,403 | 4/1996 | Raudaskoski | 242/527.3 |
| 5,544,841 | 8/1996 | Didier et al. | 242/541.7 X |
| 5,562,261 | 10/1996 | Beisswanger et al. | 242/542 X |
| 5,690,298 | 11/1997 | Ruck | 242/542.3 |

FOREIGN PATENT DOCUMENTS

| | | |
|---|---|---|
| 921789 | 3/1992 | Finland . |
| 9115481.2 | 9/1992 | Germany . |
| 0561154 | 9/1993 | Germany . |
| WO 95/13980 | 5/1995 | WIPO . |

*Primary Examiner*—Donald P. Walsh
*Assistant Examiner*—William A. Rivera
*Attorney, Agent, or Firm*—Steinberg, Raskin & Davidson, P.C.

[57] ABSTRACT

A method and device for winding a material web, such as a paper web, onto a spool or equivalent through a winding nip formed between a cylinder, roll or equivalent and the roll that is being formed. The transfer of air taking place through the winding nip along with the material web to be wound is retarded and/or prevented by forming a positive pressure in the wedge-shaped area placed after the winding nip.

20 Claims, 4 Drawing Sheets

METHOD AND DEVICE FOR WINDING A MATERIAL WEB

FIELD OF THE INVENTION

The invention relates to a method for winding a material web, in particular a paper web, in which the material web is wound onto a spool or equivalent through a winding nip formed between a cylinder, roll or equivalent and the roll that is being formed about the spool or equivalent roll core.

Further, the invention relates to a device for winding a material web, in particular a paper web, in which the web is wound onto a spool or equivalent through a winding nip formed between the roll that is being formed and a cylinder, roll or equivalent.

BACKGROUND OF THE INVENTION

In the prior art, web winders are known, for example carrier-drum slitter-winders and Pope-type winders, by whose means a material web is wound through a winding nip formed between a drum and the roll that is being formed. It is also known in the prior art to provide a carrier-drum slitter-winder with air relief.

With respect to the prior art related to such constructions, reference is made, for example, to Finnish Patent Application No. 921789 which describes a support-roll winding machine for winding a material web that has been divided by slitting onto spools without shafts. In the winding machine, there are two support rolls on which the winding rolls rest during the winding operation. In this arrangement, there are means for sealing the space formed by the support rolls and the winding rolls and for forming a pressure in that space.

FIG. 4A illustrates a prior art carrier-drum slitter-winder with air relief. In this prior art construction, the air relief is provided by means of a pressure $P_2$ produced between the carrier drums 11,12 and the roll 10 being formed. However, the generation of this pressure increases the problem which always occurs in high-speed winding of a material web W, as well as in other situations, i.e., the penetration of air through the winding nip between the material web W that is being wound and the material that is already present on the roll 10. These problems are emphasized in particular when material webs are being wound that are poorly penetrable by gas.

The entry of air between the web being wound and the material that is already wound on the roll is detrimental because when air enters between the layers of material web, the friction forces become lower, the friction forces being the forces by whose means the layers of material web adhere to one another and remain stationary in relation to one another. In a situation in which the web layers are not locked with one another, i.e., diminished friction forces, the roll becomes unstable because the layers in the roll can move in the lateral direction in relation to one another, in which case the roll "falls over". It is another disadvantage that if the locking of the layers in relation to one another is very poor, the compression force directed at the winding core, which is mainly caused by the web tightness, can become so high that it finally crushes the tube that is used as the winding core and that has been produced by gluing from cardboard.

The problem described above is also illustrated by FIG. 4B, which represents the prior art and which is a schematic illustration of the conduct of a material web in a winding nip and a schematic sectional view of a winding nip between a grooved carrier drum 11 and the roll 10 that is being wound onto a roll core. In grooves 21 on the grooved carrier drum

11, there is the outside pressure $P_1$. The web W that is being wound is placed onto the carrier drum 11 and has arrived thereat from a relief area in which a pressure $P_2$ prevails. As shown in FIG. 4B, the pressure $P_2$ present in the relief area attempts to press the material W that is being wound toward the bottom regions of the grooves 21 on the carrier drum 11, whereby pressurized pockets corresponding to the grooves 21 are formed, and along these pressurized pockets, the high-pressure air has access between the web layers W on the roll 10 that is formed.

FIG. 4C is a schematic illustration of a situation known from the prior art, in which there is rather frequent variation in the cross-direction profile of the paper/board web W, e.g., in the thickness, tension or density profile, whereby the roll 10 surface 10' becomes "grooved" or lumpy. Since on arrival onto the roll 10, the web W follows the winding drum 11, which can also be grooved, the web W attempts to be straight and thus gaps 10" (air pockets) remain between the web W and the roll 10 that is wound. These air pockets promote access of air between the layers in the web roll 10.

OBJECTS AND SUMMARY OF THE INVENTION

Accordingly, it is an object of the present invention to provide a winder in which problems of the sort described above and arising from transfer of air do not occur during winding of a material web.

It is another object of the invention to provide a winder for winding material webs in which the problems and disadvantages of prior art constructions vis-a-vis the efficient winding of the web onto a roll core are substantially avoided.

It is yet another object of the invention to provide a new and improved method and device for winding a material web, in particular a paper web.

In view of achieving the objects stated above and others, in the method in accordance with the invention, the transfer of air taking place through the winding nip along with the material web to be wound is retarded and/or the transfer of air is prevented by forming a positive pressure in the wedge-shaped area placed after the winding nip. By means of this pressure generation, a counter pressure of sorts is created impeding the flow of air from the space before the winding nip to the space after the winding nip (i.e., the transfer of air through the winding nip) and thus air dos not enter between the layers of the material web.

In the device in accordance with the invention, means are provided to generate a positive pressure in a wedge-shaped area placed after the winding nip with a view toward retarding and/or preventing the transfer of air taking place through the winding nip along with the material web to be wound. In one embodiment, the pressure in the wedge-shaped area after the winding nip is raised to balance the pressure difference between the area immediately before the winding nip and the wedge-shaped area immediately after the winding nip to substantially prevent the transfer of air through the winding nip along with the web to be wound onto the roll being formed.

In the invention, the prior art air transfer problem has been solved so that the carriage and passage of air through the winding nip has been prevented or at least substantially retarded.

According to the invention, this is achieved in accordance with a first exemplifying embodiment of the invention so that, in the wedge-shaped gap formed by the winding drum and by the roll directly after the winding nip, a pressure chamber is formed which balances a pressure difference between the relief pressure and the normal atmospheric pressure and prevents access of air into the roll that is being formed, i.e., between the layers of material web winding onto the roll being formed.

In a second exemplifying embodiment, high-pressure air is blown into the wedge-shaped area after the winding nip, whereby the same effect is produced.

In this application, the invention is described mainly in connection with a carrier drum winder with air relief, but the same basic idea can be applied also in connection with other winders and slitter-winders in which air is carried along with the face of the material web between the layers on the roll that is being formed. In this manner, the phenomenon of "falling over" of a roll or its less severe form "concave/convex-headedness" can be eliminated with highly impermeable material grades. The invention is suitable for use in connection with different winders, for example with winders in which a winding cylinder is used and in which the winding cylinder and the roll that is being formed from a winding nip.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
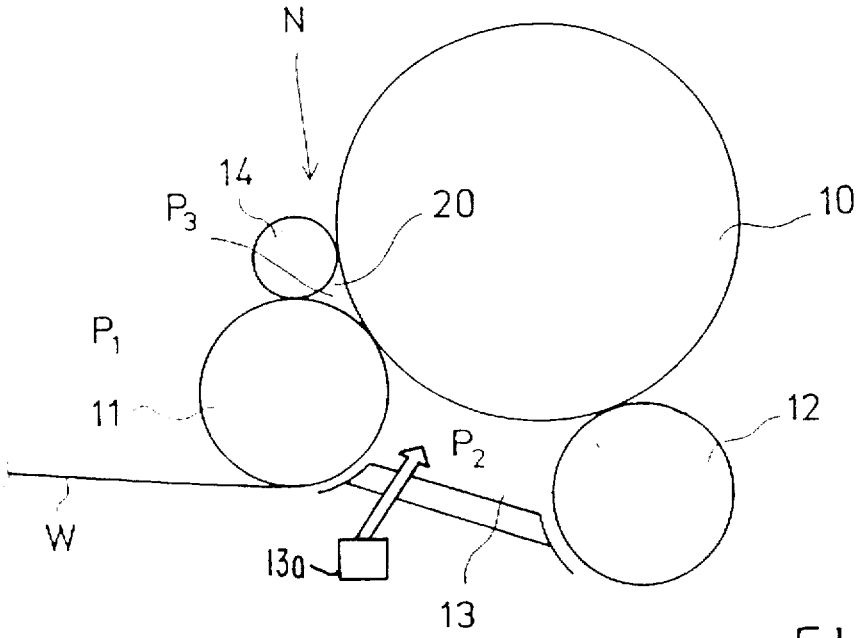
FIG. 1 is a schematic illustration of a first exemplifying embodiment of the invention in a carrier-drum slitter-winder.

Referring to the accompanying drawings wherein the same reference numerals refer to the same or similar elements, FIG. 1 shows a carrier-drum slitter-winder in which a paper roll 10 is formed while supported on the carrier drums 11 and 12. In an area 13 between the carrier drums 11 and 12, an air relief has been formed, e.g., by blowings from a blow device 13*a*, wherein a pressure $P_2$ is effective. The normal atmospheric pressure is denoted by reference $P_1$. The paper web W to be wound is passed through a winding nip N defined between the first carrier drum 11 and the paper roll 10 that is being formed onto the paper roll 10. A wedge-shaped area 20 defined after the carrier drum 11 and the paper roll 10 that is being formed (in the running or winding direction of the web) is sealed by sealing means or sealing members, for example a roll 14, and is arranged to be subjected to a positive pressure (i.e., an added or additional pressurization causing a raised or higher pressure level than previously existing), whereby a pressure $P_3$ is effective in the area 20. Roll 14 is arranged proximate to the carrier drum 11 and the roll 10 being formed to enable it to provide some sealing effect. In such a case, air cannot pass from the air relief area 13, along with the paper web W, to locations between the layers in the roll 10 that is formed because the pressure chamber formed in the area 20 substantially balances the difference between the relief pressure $P_2$ and the normal atmospheric pressure $P_1$.

Figure 2:
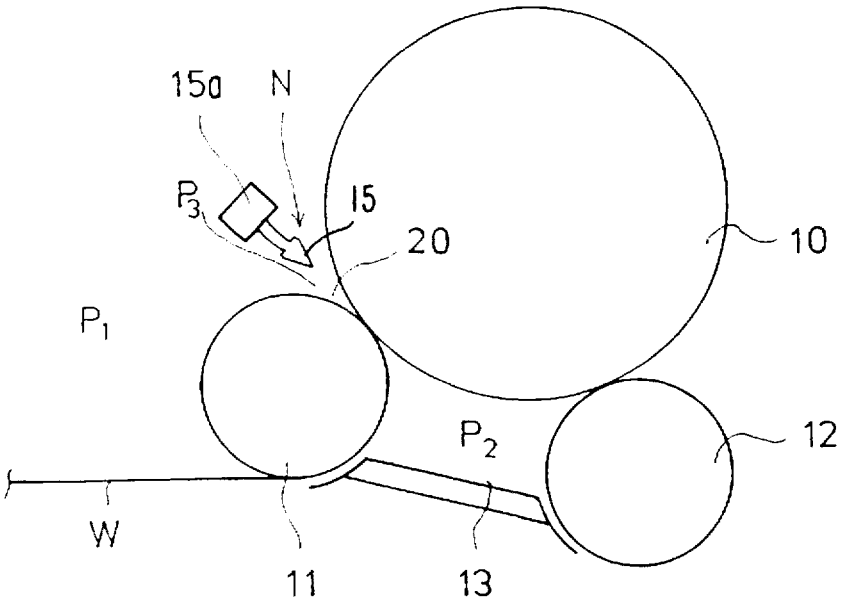
FIG. 2 is a schematic illustration of a second exemplifying embodiment of the invention in a carrier-drum slitter-winder.

In the exemplifying embodiment shown in FIG. 2, the paper web W is wound onto a paper roll 10 in a carrier-drum slitter-winder, which includes the carrier drums 11 and 12. Between the carrier drums 11 and 12, an air relief area 13 is provided, in which the pressure $P_2$ is effective. In the environment, the normal atmospheric pressure $P_1$ is effective. Into the wedge-shaped area 20 placed after the nip N defined between the first carrier drum 11 and the paper roll 10 that is formed (in the running direction of the web), air is blown from air blow means 15*a* as a directed air blowing 15, whereby the wedge-shaped area 20 is pressurized, its pressure value being $P_3$. Thus, air is prevented from being carried from the air relief area $P_2$ along with the paper web W between the material layers on the paper roll 10 because the positive pressure $P_3$ effective in the area 20 balances the difference between the pressure $P_1$ in the environment and the air relief pressure $P_2$.

Figure 3:
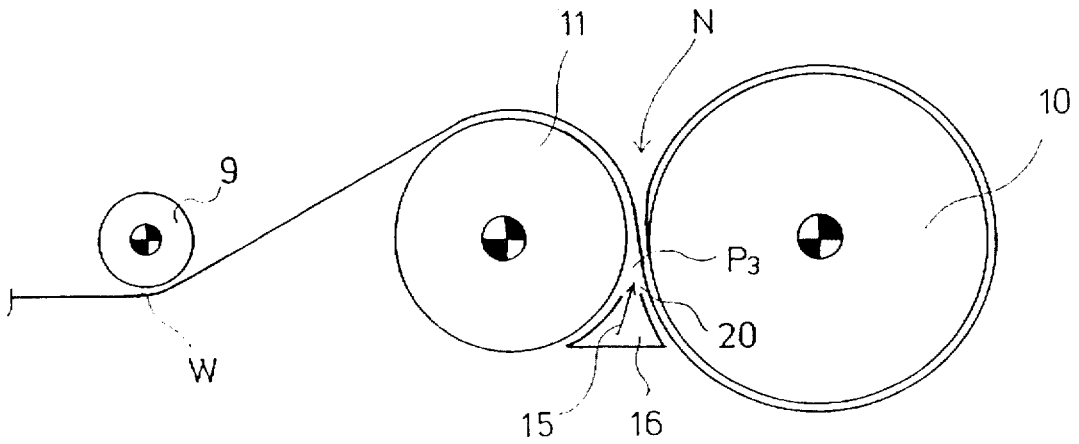
FIG. 3 is a schematic illustration of a third exemplifying embodiment of the invention in a Pope-type winder.
Figure 4A:
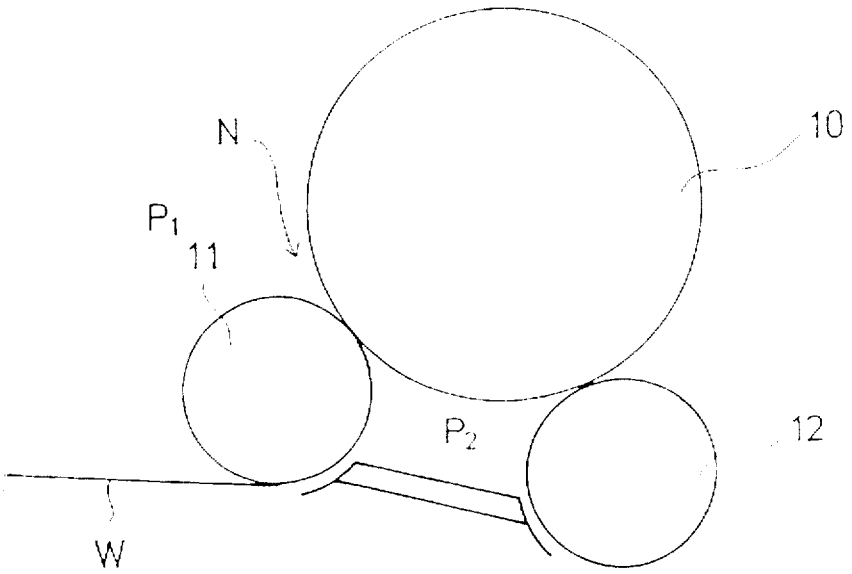
FIG.4A PRIOR ART
FIGS. 4A, 4B and 4C are schematic illustrations of prior art winding arrangements.
Figure 4B:
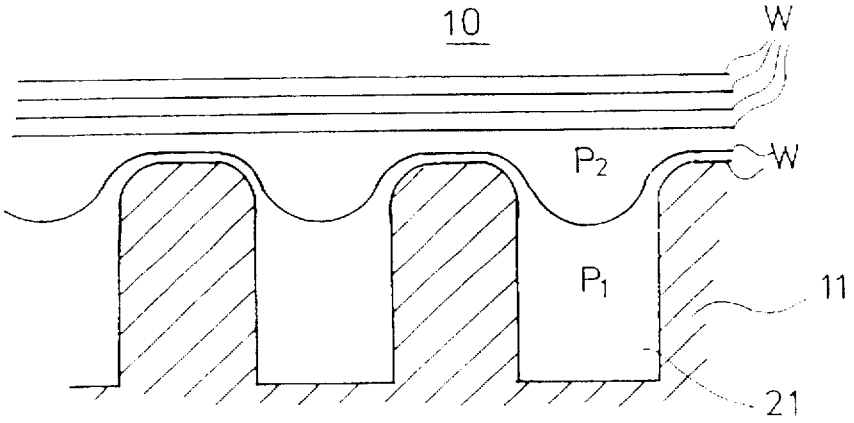
FIG.4B PRIOR ART
Figure 4C:
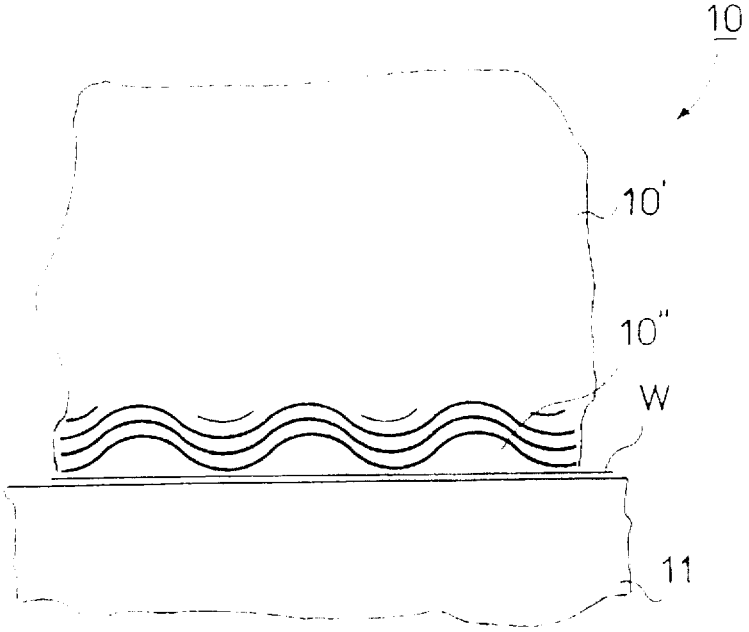
FIG.4C PRIOR ART

In the exemplifying embodiment shown in FIG. 3, the paper web W is wound onto a paper roll 10 in a Pope-type winder in which the paper web W is passed from a guide roll 9 over a winding cylinder 11 into the winding nip N defined between the winding cylinder 11 and the paper roll 10 that is formed. From the winding nip, the web W is passed onto the paper roll 10. Air is blown from air blow means such as a blow device 16 as directed blowings 15 into the wedge-shaped area 20 after the winding nip N in the winding direction of the web, whereby the wedge-shaped area 20 is pressurized, and its pressure value is $P_3$. Thus, from the area preceding the winding nip N, air is prevented from being carried along with the paper web W between the material layers on the paper roll 10 that is being formed, i.e., the transfer of air from the area before the winding nip to the area after the winding nip is substantially reduced or retarded.

It should be recognized that the weight of the roll 10 being formed is relieved by pressurizing the area underneath the roll being formed before the winding nip N, e.g., by the relief means 13*a*. More particularly, in one embodiment, the roll 10 being formed is supported by arranging the drums or cylinders 11, 12 spaced a distance from one another to define the air relief area which encompasses at least a part of a lower half of the roll 10 being formed. Thus, upon pressurizing this area 13 between the drums 11,12, the weight of the roll 10 being formed is relieved.

The examples provided above are not meant to be exclusive. Many other variations of the present invention would be obvious to those skilled in the art, and are contemplated to be within the scope of the appended claims. For example, instead of the air relief blow box 13*a*, other air relief pressure means may be used without deviating from the scope and spirit of the invention.

I claim:

1. A method for winding a material web onto a roll being formed, comprising the steps of:

arranging first and second cylinders at a distance from one another and to form a respective first and second winding nip with the roll being formed, an air relief area being situated at least partially below the roll being formed and being defined by the first and second cylinders and the roll being formed, passing the web through the air relief area into the first winding nip such that the air relief area is situated before the first winding nip in a running direction of the web and a wedge-shaped area is situated immediately after the first winding nip exterior of the air relief area, transferring the web in the first winding nip from the first cylinder onto the roll being formed while rotating the roll being formed to cause the web to wind onto the roll being formed, carrying the web over the roll being formed exterior of the air relief area into the second winding nip, and raising the pressure in the wedge-shaped area after the first winding nip to reduce the transfer of air from the air relief area through the first winding nip into the wedge-shaped area after the first winding nip along with the web to be wound onto the roll being formed.

2. The method of claim 1, further comprising the step of sealing the wedge-shaped area after the first winding nip.

3. The method of claim 2, wherein the step of sealing the wedge-shaped area comprises the step of arranging a roll alongside the first cylinder and the roll being formed and proximate the first cylinder and the roll being formed.

4. The method of claim 1, wherein the step of raising the pressure in the wedge-shaped area after the first winding nip comprises the step of blowing air into the wedge-shaped area to pressurize the wedge-shaped area.

5. The method of claim 1, further comprising the step of:

relieving the weight of the roll being formed on at least one of the first and second cylinders by pressurizing the air relief area.

6. The method of claim 1, wherein the air relief area encompasses at least a part of a lower half of the roll being formed, further comprising the step of:

pressurizing the air relief area to relieve the weight of the roll being formed on both of the first and second cylinders.

7. The method of claim 1, wherein the step of raising the pressure in the wedge-shaped area after the first winding nip comprises the step of raising the pressure in the wedge-shaped area after the first winding nip until the pressure in the wedge-shaped area after the first winding nip is substantially equal to the pressure in the air relief area before the first winding nip.

8. The method of claim 1, further comprising the step of:

supporting the roll being formed on the first and second cylinders.

9. The method of claim 1, further comprising the step of:

arranging the second cylinder a distance from the first cylinder such that the air relief area encompasses at least a part of a lower half of the roll being formed and each layer of the web of the roll being formed travels on the roll being formed from the first winding nip over an upper portion of the roll being formed to the second winding nip.

10. An arrangement for winding a material web onto a roll being formed about a spool, comprising a first cylinder arranged to define a first winding nip with the roll being formed through which the web is passed, a second cylinder arranged at a distance from said first cylinder and to define a second winding nip with the roll being formed through which the web passes after traveling from said first winding nip around the roll being formed, said first and second cylinders and the roll being formed being arranged relative to one another to define an air relief area situated at least partially below the roll being formed, the web being passed through said air relief area into said first winding nip such that said air relief area is situated before said first winding nip in a running direction of the web and a wedge-shaped area is situated immediately after said first winding nip exterior of said air relief area, the web being transferred in said first winding nip from said first cylinder onto the roll being formed while the roll being formed is rotated to cause the web to wind onto the roll being formed, and first pressure means for raising the pressure in said wedge-shaped area after said first winding nip to reduce the transfer of air from said air relief area through said first winding nip into said wedge-shaped area after said first winding nip along with the web to be wound onto the roll being formed.

11. The device of claim 10, further comprising sealing means for sealing said first wedge-shaped area after said winding nip.

12. The device of claim 11, wherein said sealing means comprise a roll arranged alongside said first cylinder and the roll being formed and proximate said first cylinder and the roll being formed.

13. The device of claim 10, wherein said first pressure means comprise blow means for blowing air into said wedge-shaped area after said first winding nip to pressurize said wedge-shaped area.

14. The device of claim 10, further comprising relief means for relieving the weight of the roll being formed on at least one of said first and second cylinders, said relief means comprising second pressure means for generating a positive pressure in said air relief area before said first winding nip.

15. The device of claim 10, wherein said first and second cylinders are arranged to support the roll being formed, further comprising second pressure means for generating a positive pressure between said first and second cylinders to relieve the weight of the roll being formed on both of said first and second cylinders.

16. The device of claim 10, wherein said first pressure means are structured and arranged to raise the pressure in said wedge-shaped area after said first winding nip until the pressure in said wedge-shaped area is substantially equal to the pressure in said air relief area immediately before said first winding nip.

17. The arrangement of claim 10, wherein said second cylinder is arranged a distance from said first cylinder and such that the air relief area encompasses at least a part of a lower half of the roll being formed and each layer of the web of the roll being formed travels on the roll being formed from said first winding nip over an upper portion of the roll being formed to said second winding nip.

18. An arrangement for winding a material web onto a roll being formed about a spool, comprising a cylinder arranged horizontally alongside the roll being formed such that said cylinder does not support the roll being formed and to define a winding nip with the roll being formed, the web being passed over an upper portion of said cylinder into said winding nip and transferred in said winding nip from said cylinder onto the roll being formed, a wedge-shaped area being defined after and below said winding nip in a running direction of the web by said cylinder and the roll being formed, and pressure means for raising the pressure in said wedge-shaped area after and below said winding nip to reduce the transfer of air from an area before and above said winding nip through said winding nip into said wedge-shaped area after and below said winding nip along with the web to be wound onto the roll being formed.

19. The arrangement of claim 18, wherein said pressure means comprise a blow device for directing blowings into said wedge-shaped area.

20. The arrangement of claim 18, further comprising a guide roll for directing the web in a path over the upper portion of said cylinder.

* * * * *